US009646559B2

(12) United States Patent
Min et al.

(10) Patent No.: US 9,646,559 B2
(45) Date of Patent: May 9, 2017

(54) LIQUID CRYSTAL DISPLAY DEVICE

(71) Applicant: LG Display Co., Ltd., Seoul (KR)

(72) Inventors: Woong Ki Min, Paju-si (KR); Heum Seok Baek, Goyang-si (KR); Mi Young Son, Paju-si (KR); Ho June Kim, Paju-si (KR); Yoon San Park, Goyang-si (KR); Sung Gon Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/960,099

(22) Filed: Aug. 6, 2013

(65) Prior Publication Data

US 2014/0043306 A1 Feb. 13, 2014

(30) Foreign Application Priority Data

Aug. 10, 2012 (KR) ..... 10-2012-0087817
Aug. 10, 2012 (KR) ..... 10-2012-0087857

(51) Int. Cl.
*G09G 3/36* (2006.01)

(52) U.S. Cl.
CPC ..... *G09G 3/3685* (2013.01); *G09G 3/3677* (2013.01); *G09G 2300/0426* (2013.01);
(Continued)

(58) Field of Classification Search
CPC . G06F 3/038; G09G 5/00; G09G 3/20; G09G 2300/0439; G09G 3/2983; G09G 3/2003; G09G 2300/0443; G09G 2300/0447; G09G 2300/0469; G09G 2300/0478; G09G 2300/0434; G09G 3/3685; G09G 3/3677; G09G 2300/0426;
(Continued)

(56) References Cited

U.S. PATENT DOCUMENTS

2004/0164995 A1* 8/2004 Mori ..... 345/617
2009/0086116 A1 4/2009 Pak
(Continued)

FOREIGN PATENT DOCUMENTS

CN 101097335 A 1/2008
CN 101399026 A 4/2009
(Continued)

*Primary Examiner* — Olga Merkoulova
*Assistant Examiner* — Jarurat Suteerawongsa
(74) *Attorney, Agent, or Firm* — Birch, Stewart, Kolasch & Birch, LLP

(57) ABSTRACT

A display device including a panel having a display area and first, second, third and fourth non-display areas formed at an outer portion of the display area, said first non-display area facing the second non-display area, and the third non-display area facing the fourth non-display area; a data driver disposed in the first non-display area, and configured to drive a plurality of data lines provided in a first direction in the display area; a gate driver disposed in the second non-display area and configured to drive a plurality of gate lines provided in a second direction vertical to the first direction in the display area; a timing controller configured to drive the data driver and the gate driver; and a plurality of link lines in the display area and extending from the gate driver and provided in parallel to the data lines respectively connected to the gate lines.

18 Claims, 12 Drawing Sheets

(52) U.S. Cl.
CPC ..... *G09G 2310/0218* (2013.01); *G09G 2310/0281* (2013.01); *G09G 2320/0223* (2013.01)

(58) Field of Classification Search
CPC ... G09G 2310/0218; G09G 2320/0223; G09G 3/36
See application file for complete search history.

(56) References Cited

U.S. PATENT DOCUMENTS

| | | | | |
|---|---|---|---|---|
| 2009/0167675 | A1 | 7/2009 | Park et al. | |
| 2010/0097538 | A1 | 4/2010 | Ota | |
| 2010/0156776 | A1 | 6/2010 | Jeoung et al. | |
| 2012/0026206 | A1* | 2/2012 | Moon ..... | G09G 3/3614 345/690 |
| 2012/0033169 | A1 | 2/2012 | Lee | |
| 2012/0056835 | A1 | 3/2012 | Choo et al. | |
| 2012/0127405 | A1* | 5/2012 | Lee et al. ..... | 349/106 |
| 2012/0127412 | A1* | 5/2012 | Lee et al. ..... | 349/139 |

FOREIGN PATENT DOCUMENTS

| | | | |
|---|---|---|---|
| CN | 101470284 | A | 7/2009 |
| CN | 101487962 | A | 7/2009 |
| CN | 101726895 | A | 6/2010 |
| CN | 102346342 | A | 2/2012 |
| CN | 102402330 | A | 4/2012 |
| CN | 102478728 | A | 5/2012 |

* cited by examiner

LIQUID CRYSTAL DISPLAY DEVICE

CROSS-REFERENCE TO RELATED APPLICATIONS

This application claims the benefit of the Korean Patent Application Nos. 10-2012-0087817 and 10-2012-0087857 both filed on Aug. 10, 2012, which are hereby incorporated by reference as if fully set forth herein.

BACKGROUND OF THE INVENTION

Field of the Invention

The present invention relates to a display device such as a liquid crystal display (LCD) device, and more particularly, to a display device with a narrow bezel and a driving method thereof.

Discussion of the Related Art

Flat panel display (FPD) devices are applied to various electronic products such as portable phones, tablet personal computers (PCs), notebook computers, etc. The FPD devices include liquid crystal display (LCD) devices, plasma display panels (PDPs), organic light emitting diode (OLED) display devices, etc. Recently, electrophoretic display (EPD) devices are widely used as FPD devices.

In such FPD devices, LCD devices display an image using the optical anisotropy of liquid crystal. Because the LCD devices have a thin thickness, a small size, and low power consumption and realize a high-quality image, the LCD devices are widely used.

Research on LCD devices can be classified into a technical aspect and a design aspect. Designs more appealing to consumers are increasingly required. Therefore, efforts are being continuously made for minimizing (slimming) the thicknesses of LCD devices.

Moreover, research is being actively done on a technology (narrow bezel technology) that narrowly forms a border portion of an LCD device. Specifically, research is being actively done on technology that minimizes left and right border portions incapable of displaying an image in the front of an LCD device, and increases a portion that displays an image, thereby providing a broader and greater screen to a user.

For example, FIG. 1 is a diagram illustrating a configuration of a related art LCD device. As shown, the related art LCD device includes a panel 10 having a display area displaying an image and a non-display area around the display area; a gate driver 20 for driving a plurality of gate lines formed in the panel 10; a data driver 30 for driving a plurality of data lines formed in the panel 10; and a timing controller 40 for driving the data driver 30 and the gate driver 20.

The data driver 30 generally is mounted in an IC area of a tape carrier package (TCP) or mounted on a base film 60 of the TCP in a chip-on film (COF) type, and connected to the panel 10 in a tape automated bonding (TAP) type. The data driver 30 is mounted on an upper end portion or lower end portion of the non-display area.

The gate driver 20 is mounted in the IC area of the TCP or mounted on the base film 60 of the TCP in the COF type, and connected to the panel 10 in the TAP type. The gate driver 20 is also mounted in the non-display area in a gate-in panel (GIP) type. Further, the gate driver 20 is generally disposed in a direction vertical to the data driver 30. That is, because the gate lines and the data lines are arranged vertically to each other in the panel 10, the gate driver 20 and the data driver 30 are also disposed vertically to each other in the non-display area.

Recently, as the lateral widths of LCD devices increase, as illustrated in FIG. 1, the gate driver 20 for driving the gate lines is disposed symmetrically to the left and right non-display areas of the LCD device. Further, each of the left and right non-display areas of a GIP type LCD device, as illustrated in FIG. 1, is divided into a GND+scribe area "a", a GIP signal area "b", a GIP circuit area "c", and a Vcom area "d" in sequence from the outermost portion thereof.

Moreover, in LCD devices having the TCP type, COF type, or chip-on glass (COG) type instead of the GIP type, each of left and right non-display areas is divided into the above-described four areas. However, even in the LCD device having the above-described configuration, research is being continuously done on narrow bezel technology for minimizing left and right non-display areas.

Generally, the technology of reducing a size of the GIP circuit area "c" is used for realizing a narrow bezel. However, a method of reducing the size of the GIP circuit area "c" has a limitation.

To overcome the limitation, a method that reduces a width of the Vcom area 50 "d" in which a common line for applying a common voltage (Vcom) to the display area is formed. However, when the Vcom area 50 "d" decreases, factors which degrade quality of the LCD device like horizontal crosstalk occur. For this reason, the method of reducing the Vcom area 50 "d" also has a limitation. Moreover, a method that reduces the ground and scribe area "a" or the GIP signal area "b" formed for applying a signal to a GIP has a limitation.

SUMMARY OF THE INVENTION

Accordingly, one object of the present invention is to provide an LCD device with a narrow bezel and a driving method thereof that substantially obviate one or more problems due to limitations and disadvantages of the related art.

Another object of the present invention is to provide an LCD device in which a gate driver for applying a scan signal to a plurality of gate lines is disposed in a second non-display area facing a first non-display area with a data driver disposed therein in a non-display area.

To achieve these and other advantages and in accordance with the purpose of the invention, as embodied and broadly described herein, the present invention provides in one aspect a display device including a panel having a display area and first, second, third and fourth non-display areas formed at an outer portion of the display area, said first non-display area facing the second non-display area, and the third non-display area facing the fourth non-display area; a data driver disposed in the first non-display area, and configured to drive a plurality of data lines provided in a first direction in the display area; a gate driver disposed in the second non-display area and configured to drive a plurality of gate lines provided in a second direction vertical to the first direction in the display area; a timing controller configured to drive the data driver and the gate driver; and a plurality of link lines in the display area and extending from the gate driver and provided in parallel to the data lines respectively connected to the gate lines.

In another aspect, the present invention provides a method of driving the display device and which includes applying a plurality of scan signals, via the gate driver, to the gate lines through the link lines such that a rising edge of a second scan signal applied to a second gate line occurs before a falling edge of a first scan signal applied to a first gate line signal so the scan signals overlap with each other.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the embodiments of the present invention, examples of which are illustrated in the accompanying drawings. Wherever possible, the same reference numbers will be used throughout the drawings to refer to the same or like parts. Hereinafter, embodiments of the present invention will be described in detail with reference to the accompanying drawings.

Figure 1:
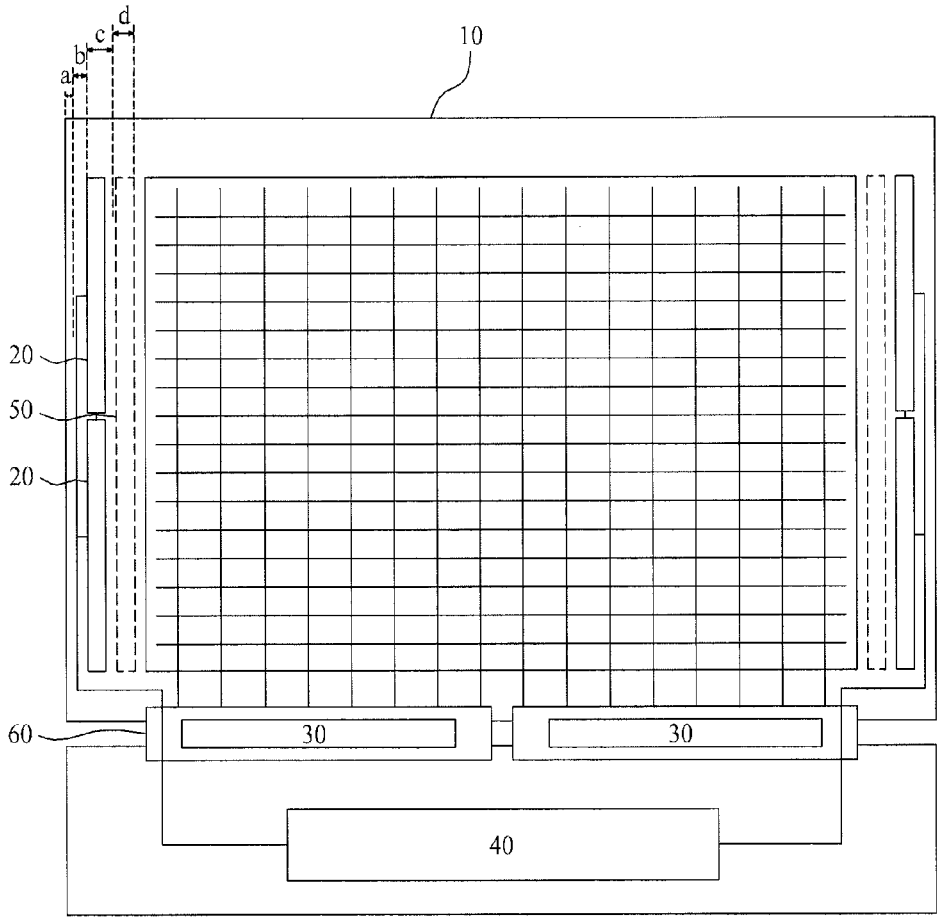
FIG. 1 Related Art
FIG. 1 is a diagram illustrating a configuration of a related art LCD device.
Figure 2:
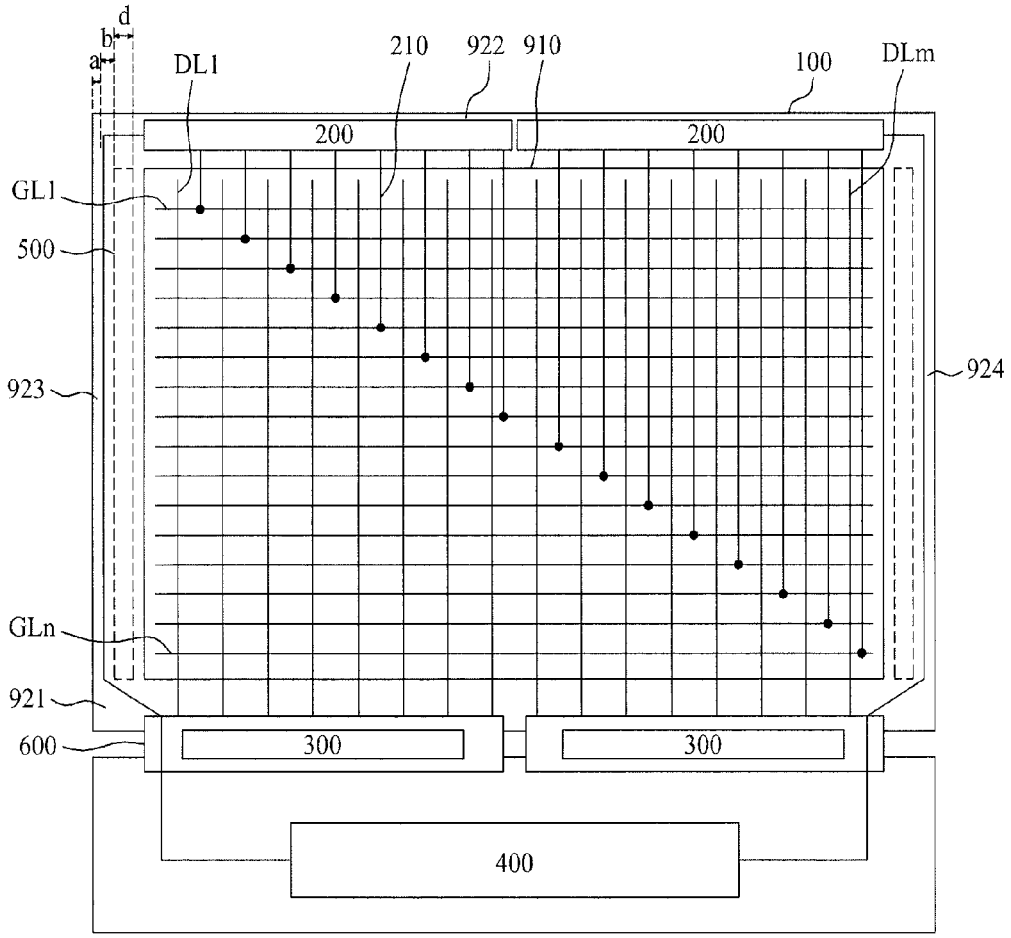
FIG. 2 is a configuration diagram illustrating an LCD device according to one embodiment of the present invention.
Figure 3:
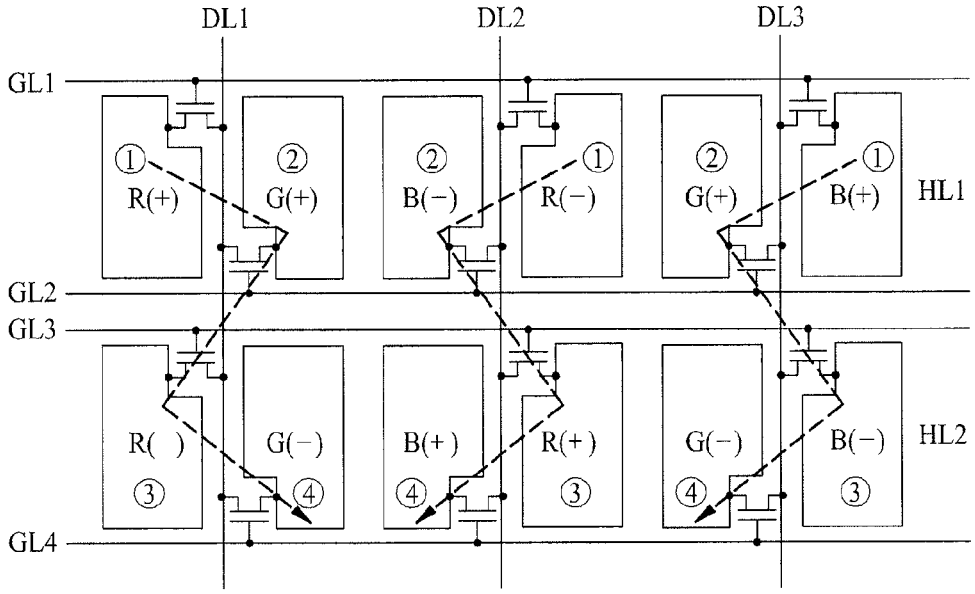
FIG. 3 is a diagram illustrating a panel of an LCD device according to an embodiment of the present invention.
Figure 12:
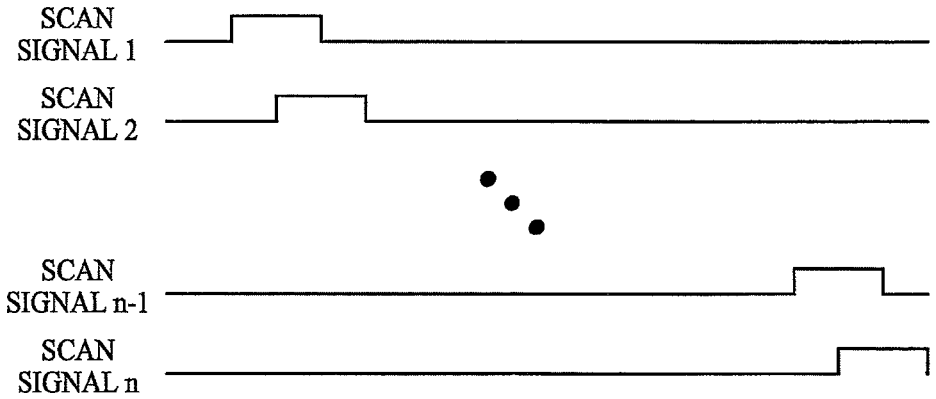
FIG. 12 is a wave form diagram illustrating scan signals applied to the present invention.

FIG. 2 is a configuration diagram illustrating an LCD device according to one embodiment of the present invention. Further, FIG. 3 is a diagram illustrating a configuration of a panel of an LCD device according to an embodiment of the present invention, and illustrates the panel driven in a double rate driving (DRD) type. FIG. 12 is a wave form diagram illustrating scan signals applied to the present invention.

As shown in FIG. 2, the LCD device includes a panel 100 that has a display area 910 and four non-display areas 921 to 924 formed at an outer portion of the display area 910; a data driver 300 disposed in the first non-display area 921 for driving a plurality of data lines DL1 to DLm formed in a first direction (vertical axis direction) in the display area 910; a gate driver 200 disposed in the second non-display area 922 facing the first non-display area 921 for driving a plurality of gate lines GL1 to GLn formed in a second direction (horizontal axis direction) vertical to the first direction in the display area 910; and a timing controller 400 for driving the data driver 300 and the gate driver 200.

A plurality of link lines 210 respectively connected to the gate lines GL1 to GLn are extended from the gate driver 200 and provided in parallel to the data lines, in the display area 100. Further, a common voltage area 500 "d", through which a plurality of lines for applying a common voltage to the display area 100 pass, is formed in each of the third and fourth non-display areas 923 and 924 formed between the first and second non-display areas 921 and 922.

A signal area "b", through which a plurality of signal lines for applying signals output from the timing controller 400 to the gate driver 200 pass is formed in each of the third and fourth non-display areas 923 and 924. In addition, a ground and scribe area "a" is formed at the outermost portion of each of the third and fourth non-display areas 923 and 924.

Further, the panel 100 includes a plurality of pixels (PXL) respectively formed in a plurality of areas defined by intersections of the gate lines GL1 to GLn and data lines DL1 and DLm, and each of the pixels includes a thin film transistor (TFT) and a pixel electrode. A common electrode, receiving the common voltage from the common voltage area 500, is also provided in each pixel of the panel 100.

In addition, the panel 100 applied to an embodiment of the present invention uses the DRD type. The DRD type is used for decreasing the number of data drivers (data driving ICs) 300 of the LCD device, and is a method that increases the number of gate lines by two times and decreases the number of data lines by half compared to the related art, and thus reduces the number of data driving ICs 300 by half and realizes the same resolution.

That is, as illustrated in FIG. 3, the LCD device according to an embodiment of the present invention uses the DRD type that drives P (where P is a natural number equal to or more than two) number of liquid crystal cells arranged on one horizontal line of the panel 100 by using two gate lines and P/2 (=m) number of data lines.

The DRD type drives the data driver (data driving IC) 300 in a vertical 2-dot inversion type, for minimizing flickers and reducing power consumption. Therefore, two pixels adjacent to each other with a data line therebetween are respectively connected to two gate lines, and respectively charged with data voltages of the same polarity supplied thereto through the data lines. The DRD type is technology that is generally used at present, and thus its detailed description is not provided.

In an embodiment of the present invention, the link lines 210 are provided in a residual space which is obtained by using the DRD type. That is, according to the DRD type, the number of data lines decreases by half compared to a general type of the related art, and thus the link lines 210 are provided in a residual space that is secured by decreasing the data lines by half.

In addition, the gate driver 200 supplies a scan signal to the gate lines with gate control signals GCS generated by the timing controller 400. In response to the scan signal, the TFTs of the liquid crystal panel 100 are driven in units of a horizontal line.

Further, the gate driver 200 as illustrated in FIG. 2 is disposed in the second non-display area 922 facing the first non-display area 921 with the data driver 300 disposed therein. That is, in the related art LCD device, the gate driver is disposed in the third non-display area 923 or the fourth non-display area 924, but in one embodiment of the present invention, the gate driver 200 is disposed in the second non-display area 922 facing the data driver 300.

In this embodiment of the present invention, as described above, the link lines 210 extended from the gate driver 200 disposed in the second non-display area 922 are provided in the display area 910 in parallel to the data lines. The link lines 210 are also connected to the gate lines in one-to-one correspondence relationship.

That is, the link lines 210 are provided vertically to the gate lines in the display area 910. Therefore, a plurality of the scan signals sequentially output from the gate driver 200 are sequentially output through the link lines 210, and sequentially applied to the gate lines respectively connected to the link lines 210.

Further, the scan signals may be applied to the gate lines GL1 to GLn through the link lines 210 so as to overlap with each other. That is, in order to advantageously increase an amount of electrical charges charged into each pixel, the gate driver 200 can output the scan signals such that some of the scan signals supplied to the respective gate lines through the link lines 210 overlap with each other. For example, as shown in FIG. 12, a rising edge of a second scan signal (SCAN SIGNAL 2) applied to a second gate line occurs before a falling edge of a first scan signal (SCAN SIGNAL 1) applied to a first gate line signal so the scan signals overlap with each other.

Further, the data driver 300 converts digital data, transferred from the timing controller 400, into analog data voltages. The data driver 300 then supplies the data voltages for one horizontal line to the respective data lines at every one horizontal period for which the scan signal is supplied to each gate line. That is, the data driver 300 converts digital data into analog data voltages with gamma voltages supplied from a gamma voltage generator, and outputs the analog data voltages to the data lines.

The data driver 300 also includes a shift register, a latch, a digital-to-analog converter (DCA), and an output buffer. In addition, the data driver 300 applied to an embodiment of the present invention is disposed in the first non-display area 921 facing the second non-display area 922 with the gate driver 200 disposed therein.

In addition, the data lines DL1 to DLm extended from the data driver 300 are vertical to the gate lines GL1 to GLn, and are parallel to the link lines 210 extended from the gate driver 200. Further, the data driver 300 may be disposed in the first non-display area 921 in a COG type, but as illustrated in FIG. 2, the data driver 300 is mounted in an IC area of a TCP or mounted on a base film 600 of the TCP in a COF type, and disposed in the first non-display area 921 in a TAB type.

The timing controller 400 generates a gate control signal GCS for controlling an operation timing of the gate driver 200 and a data control signal DCS for controlling an operation timing of the data driver 300, by using a timing signal output from the external system, namely, a dot clock DCLK used as a reference clock in the LCD device, a vertical sync signal Vsync, a horizontal sync signal Hsync, and a data enable signal DE. The timing controller 400 also supplies image data to the data driver 300.

In addition, a plurality of the gate control signals GCS generated by the timing controller 400 include a gate start pulse GSP, a gate shift clock GSC, a gate output enable signal GOE, a gate start signal VST, and a gate clock GCK. Further, a plurality of the data control signals generated by the timing controller 400 include a source start pulse SSP, a source shift clock signal SSC, a source output enable signal SOE, and a polarity control signal POL.

Also, in the above-described embodiment of the present invention, the gate driver 200 is disposed in the second non-display area 922 facing the first non-display area 921 with the data driver 300 disposed therein, and the link lines 210 vertical to the gate lines and parallel to the data lines are extended from the gate driver 300. Also, one link line 210 is connected to one gate line. Therefore, the scan signals sequentially output from the gate driver 200 to the link lines 210 are sequentially output to the gate lines connected to the respective link lines 210.

Figure 4:
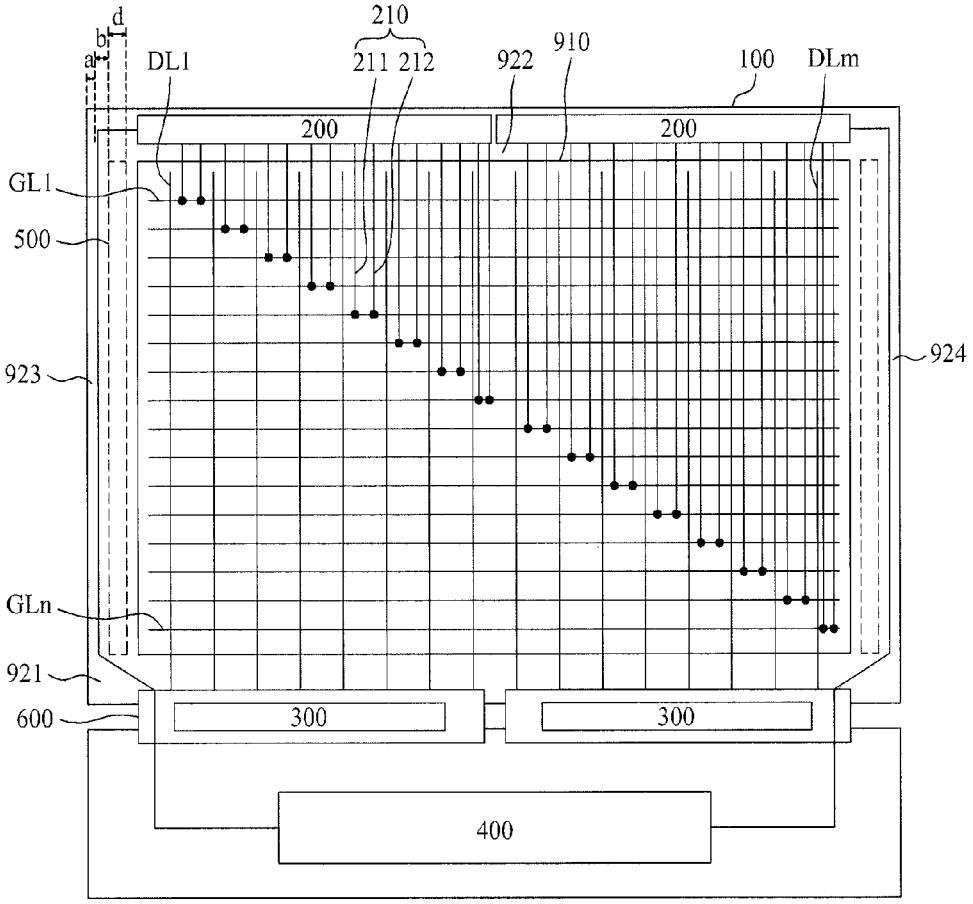
FIG. 4 is a configuration diagram illustrating an LCD device according to another embodiment of the present invention.

Next, FIG. 4 is a configuration diagram illustrating an LCD device according to another embodiment of the present invention. The configuration and function of each of the link lines 210 is different in this embodiment. Therefore, only features of this embodiment different from the previously described embodiment will be described in detail.

The LCD device according to this embodiment of the present invention also includes the panel 100, the gate driver 200, the data driver 300, and the timing controller 400. The gate driver 200 is disposed in the second non-display area 922 facing the first non-display area 921 with the data driver 300 disposed therein.

A ground and scribe area "a", a signal area "b", and a common voltage area 500 "d" are also formed sequentially in a direction from an outer portion to the display area 910, in each of the third and fourth non-display areas 923 and 924 between the first and second non-display areas 921 and 922.

Further, the plurality of link lines 210 vertical to the gate lines and parallel to the data lines are extended from the gate driver 300, and one link line 210 is connected to one gate line. However, in this embodiment of the present invention, two or more link lines 210 are connected to one gate line. In FIG. 4, the LCD device includes two link lines 210 connected to one gate line as an example.

The reason that one gate line is connected to two link lines 210 is for enhancing the scan signal applied to the gate lines. In more detail, recently-developed LCD devices are manufactured such that a width is longer than a length. Therefore, in FIG. 4, the scan signal applied to the gate line through the link line 210 connected to the gate line in a left direction of the gate line can be distorted due to a noise that occurs while the scan signal is transferred in a right direction of the gate line, or the scan signal itself can be weakened.

Also, the scan signal applied to the gate line through the link line 210 connected to the gate line in a right direction of the gate line can be distorted due to a noise that occurs while the scan signal is transferred in a left direction of the gate line, or the scan signal itself can be weakened as it travels along the scan signal especially in larger sized displays. Therefore, in this embodiment of the present invention, in order to compensate for the weakened scan signal, two or more link lines 210 are advantageously connected to one gate line, and two or more scan signals are simultaneously applied to one gate line. Thus, a stronger scan signal is applied to the gate lines.

Also, the two or more link lines connected to the one gate line can distribute one scan signal output from the gate driver 200. Moreover, the two or more link lines connected to the one gate line can apply separate scan signals, output from the gate driver 200, to the gate line. That is, the scan signal is applied to two or more link lines 210 connected to one gate line at the same timing.

Thus, in this embodiment of the present invention, more scan signals are applied to the gate lines through more link lines 210, and thus a deviation of the scan signal does not advantageously occur between left and right sides of the gate line. Accordingly, a deviation of image quality is significantly reduced between images displayed in left and right portions of the display area 910.

Moreover, the scan signals can be applied to the gate lines GL1 to GLn through the link lines 210 in overlap with each other. That is, in order to increase an amount of electrical charges charged into each pixel, the gate driver 200 can output the scan signals such that the scan signals supplied to the respective gate lines through the link lines 210 overlap with each other. That is, as shown in FIG. 12, a rising edge of a second scan signal applied to a second gate line occurs before a falling edge of a first scan signal applied to a first gate line signal so the scan signals overlap each other. A similar concept applies to the third, fourth, etc., scan signals.

For example, in FIG. 4, the scan signal is applied to two link lines (hereinafter referred to as "first link lines") connected to one gate line at the same timing. However, the scan signals are applied to other two link lines (hereinafter referred to as "second link lines") connected to a gate line adjacent to the one gate line and the first link lines at a certain time interval, and thus there is a time for which the scan signals overlap each other.

In this embodiment of the present invention, the gate driver 200 is disposed in the second non-display area 922 facing the first non-display area 921 with the data driver 300 disposed therein, and the link lines 210 vertical to the gate lines and parallel to the data lines are extended from the gate driver 300. Two or more link lines 210 are also connected to one gate line. Therefore, the scan signals simultaneously output from the gate driver 200 to the two link lines 210 are simultaneously output to the gate line connected to the two link lines 210 in common.

Figure 5:
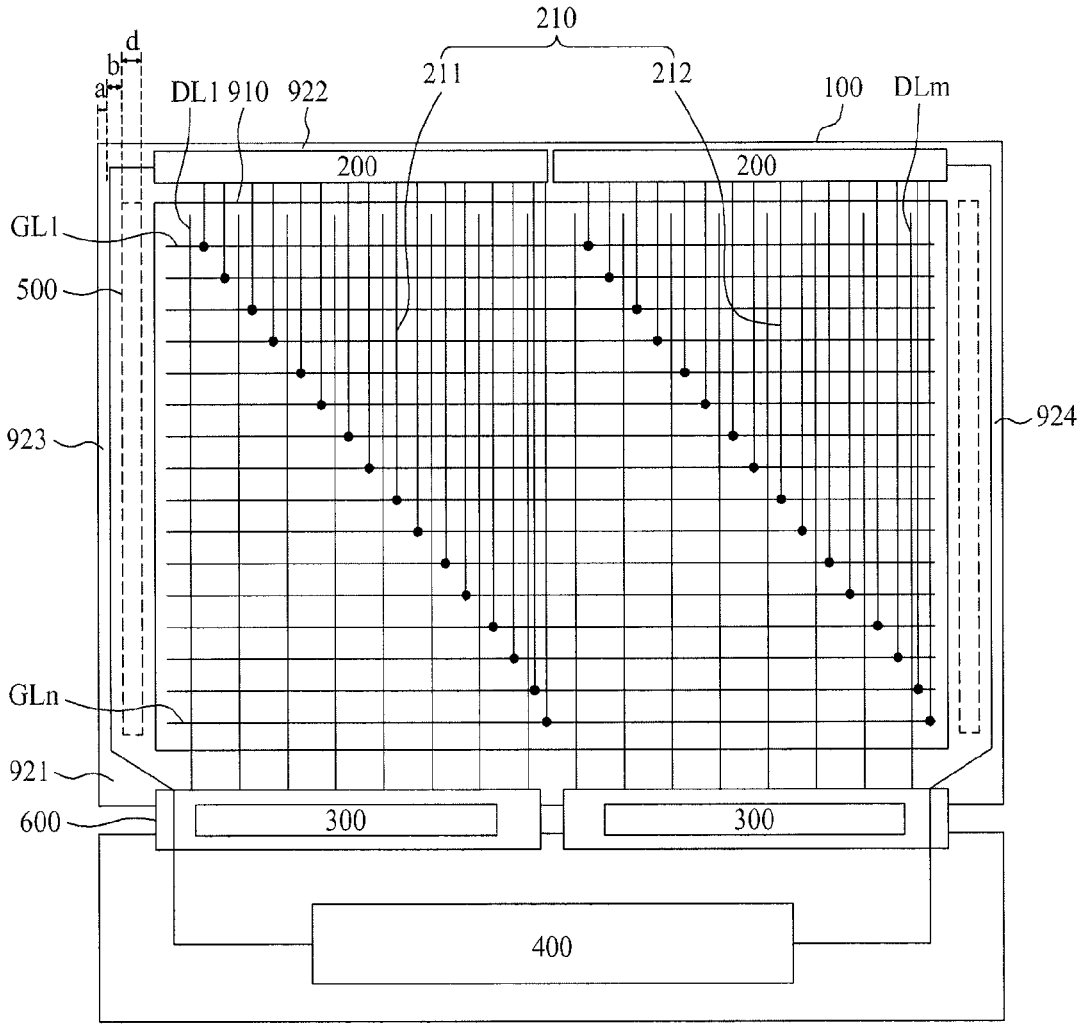
FIG. 5 is a configuration diagram illustrating an LCD device according to yet another embodiment of the present invention.

Next, FIG. 5 is a configuration diagram illustrating an LCD device according to yet another embodiment of the present invention. Again, the configuration and function of each of the link lines 210 is different than the embodiment described above with reference to FIGS. 2 and 4.

The LCD device according to this embodiment of the present invention also includes the panel 100, the gate driver 200, the data driver 300, and the timing controller 400. The gate driver 200 is disposed in the second non-display area 922 facing the first non-display area 921 with the data driver 300 disposed therein.

Further, the ground and scribe area "a", the signal area "b", and the common voltage area 500 "d" are formed sequentially in a direction from an outer portion to the display area 910, in each of the third and fourth non-display areas 923 and 924 between the first and second non-display areas 921 and 922. The plurality of link lines 210 vertical to the gate lines and parallel to the data lines are extended from the gate driver 300, and one link line 210 is connected to one gate line.

However, in this embodiment of the present invention, the gate driver 200 is divided into first to kth gate drivers. The link lines 210, which are extended from each of the first to kth gate drivers equally to the number of gate lines, are connected to the gate lines in one-to-one correspondence relationship. Here, by dividing a length direction of the gate line by k, the first to kth gate drivers can apply the same scan signals to the same gate line.

In FIG. 5, an LCD device in which the gate driver is divided into first and second gate drivers 200 is illustrated as an example. Further, the first gate driver 200 denotes a gate driver disposed at a left side of the second non-display area 922 of the liquid crystal panel 100, and the second gate driver 200 denotes a gate driver disposed at a right side of the second non-display area 922.

As illustrated in FIG. 5, the reason that one gate line is connected to two link lines 210 by using the two gate drivers is for advantageously enhancing the scan signal applied to the gate lines similarly to the second embodiment. In the embodiment in FIG. 4, two link lines 210 extended from the same gate driver are provided adjacently to each other, on one gate line. However, in this embodiment, two link lines 210 connected to one gate line are disposed apart from each other.

As illustrated in FIG. 5, when the two gate drivers are provided, two link lines are separated from each other by an interval of half of a length direction of the gate line. When three gate drivers are provided, three link lines can be separated from each other by an interval of one-third of the length direction of the gate line, and connected to one gate line.

In this instance, the scan signal is applied to two or more link lines connected to one gate line at the same timing. Specifically, because the scan signal is simultaneously applied in left and right directions of one gate line, a deviation of the scan signal is advantageously reduced between left and right sides of the gate line, and thus a deviation of image quality is advantageously minimized between images displayed in the left and right sides of the gate line.

Further, the gate driver 200 is disposed in the second non-display area 922 facing the first non-display area 921 with the data driver 300 disposed therein, and the link lines 210 vertical to the gate lines and parallel to the data lines are extended from the gate driver 300. In this instance, the link lines connected to each of two or more gate drivers are separated from each other at certain intervals and connected to one gate line, and thus can output the scan signal at the same timing.

Moreover, the scan signals can be applied to the gate lines GL1 to GLn through the link lines 210 in overlap with each other. That is, in order to increase an amount of electrical charges charged into each pixel, the gate driver 200 can output the scan signals such that the scan signals supplied to the respective gate lines through the link lines 210 overlap with each other.

For example, in FIG. 5, although the link lines are connected to different gate drivers, the scan signal is applied to two link lines (hereinafter referred to as "first link lines") connected to one gate line at the same timing. However, the scan signals are applied to other two link lines (hereinafter referred to as "second link lines") connected to a gate line adjacent to the one gate line and the first link lines at a certain time interval, and thus there is a time for which the scan signals overlap each other.

Figure 6:
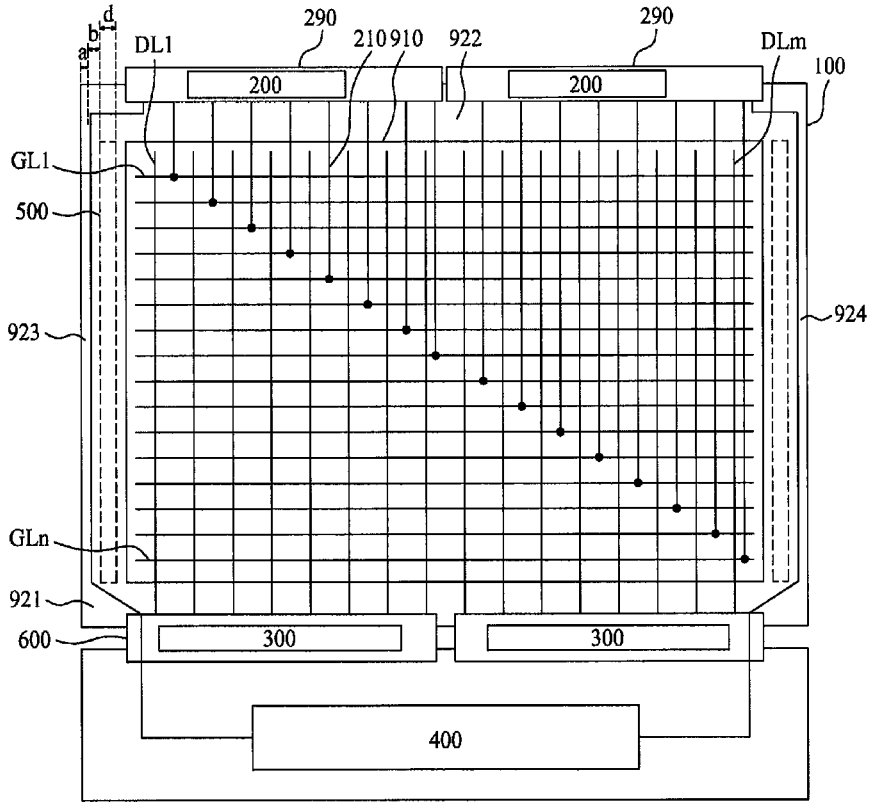
FIGS. 6 to 8 are various configuration diagrams respectively illustrating LCD devices according to still other embodiments of the present invention.
Figure 7:
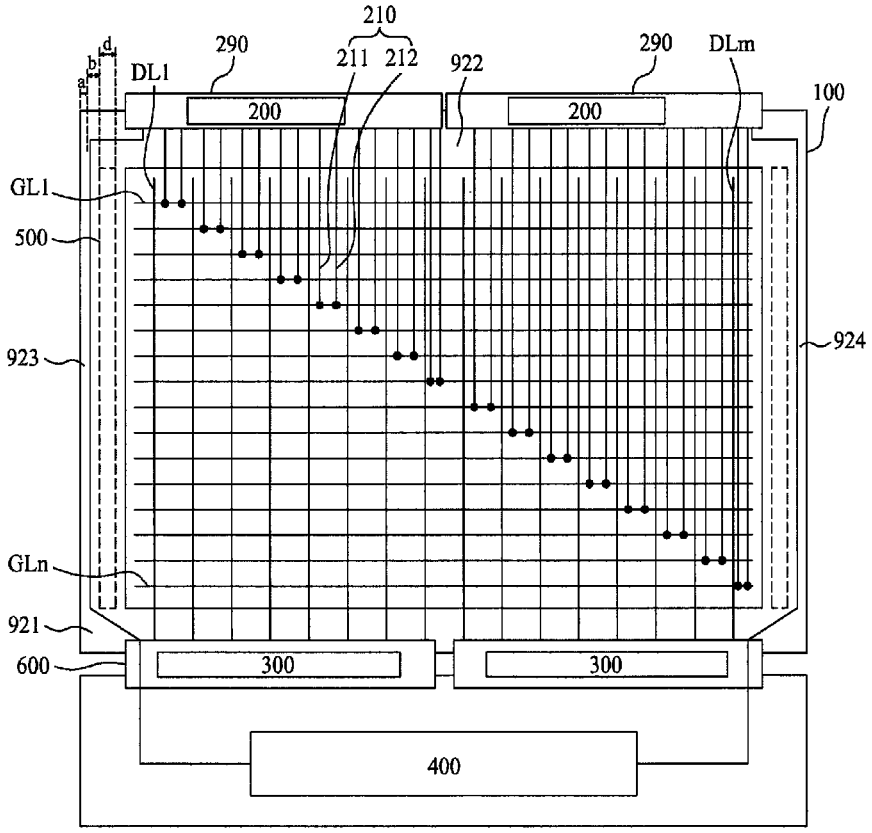
Figure 8:
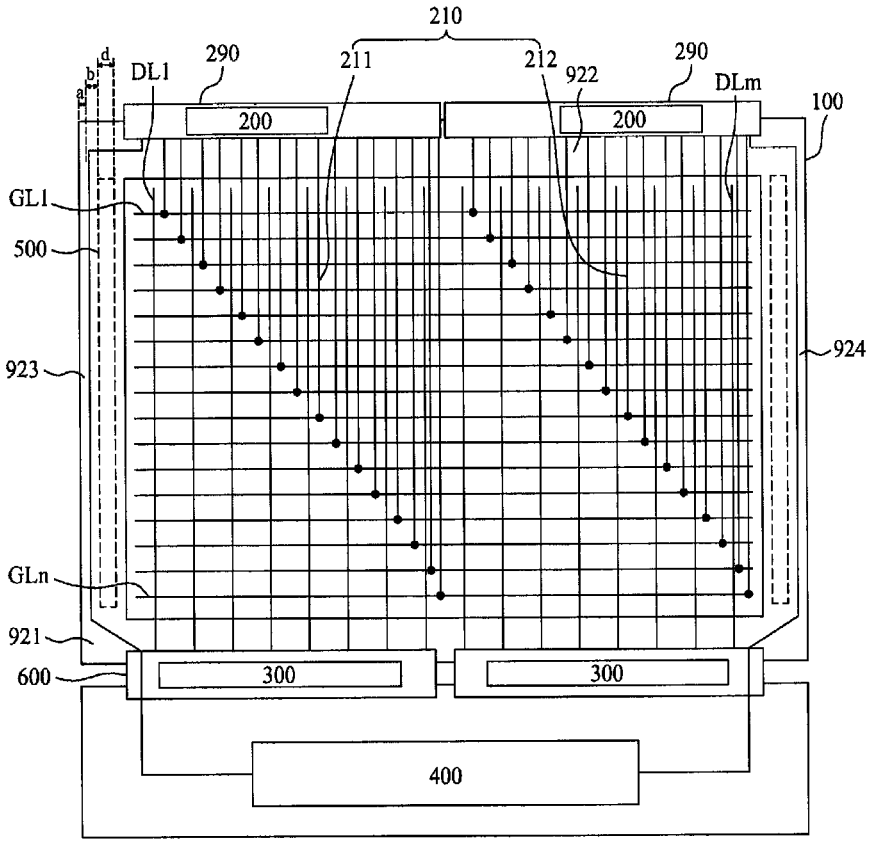

Next, FIGS. 6 to 8 are various configuration diagrams respectively illustrating LCD devices according to still other embodiments of the present invention. A configuration and function of the embodiment of the present invention illustrated in FIGS. 6-8 are similar to those of the embodiment of FIGS. 2, 4 and 5, respectively.

In the embodiment of the present invention of FIG. 6, the gate driver 200 is disposed in the second non-display area 922 facing the first non-display area 921 with the data driver 300 disposed therein, and the link lines 210 vertical to the gate lines and parallel to the data lines are extended from the gate driver 300. One link line 210 is connected to one gate line. Therefore, signals sequentially output from the gate driver 200 to the link lines 210 are sequentially output to the gate lines connected to the respective link lines 210.

Here, as illustrated in FIG. 6, the gate driver 200 is mounted in the IC area of the TCP or mounted on a base film 290 of the TCP in the COF type, and disposed in the second non-display area 922 in the TAB type. However, unlike the embodiment in which the gate driver 200 is disposed in the second non-display area 922 in the GIP type, in this embodiment, the gate driver 200 is disposed in the second non-display area 922 in the TCP or COF type. This is the primary difference from the embodiment in FIG. 2.

In the embodiment of FIG. 7, the gate driver 200 is disposed in the second non-display area 922 facing the first non-display area 921 with the data driver 300 disposed therein, and the link lines 210 vertical to the gate lines and parallel to the data lines are extended from the gate driver 300. Two or more link lines 210 are also connected to one gate line. Therefore, the scan signals simultaneously output from the gate driver 200 to the two link lines 210 are simultaneously output to the gate line connected to the two link lines 210 in common.

Unlike the embodiment in which the gate driver 200 is disposed in the second non-display area 922 in the GIP type, in this embodiment, the gate driver 200 is connected to the second non-display area 922 through the base film 290 in the TCP or COP type. This is the primary difference from the embodiment in FIG. 4.

In the embodiment of the present invention of FIG. 8, the gate driver 200 is disposed in the second non-display area 922 facing the first non-display area 921 with the data driver 300 disposed therein, and the link lines 210 vertical to the gate lines and parallel to the data lines are extended from the gate driver 300. In this instance, the link lines connected to each of two or more gate drivers may be separated from each other at certain intervals and connected to one gate line, and thus can output the scan signal at the same timing.

Unlike the embodiment in which the gate driver 200 is disposed in the second non-display area 922 in the GIP type, in this embodiment, the gate driver 200 is connected to the second non-display area 922 through the base film 290 in the TCP or COP type. This is the primary difference from the embodiment in FIG. 5.

Figure 9:
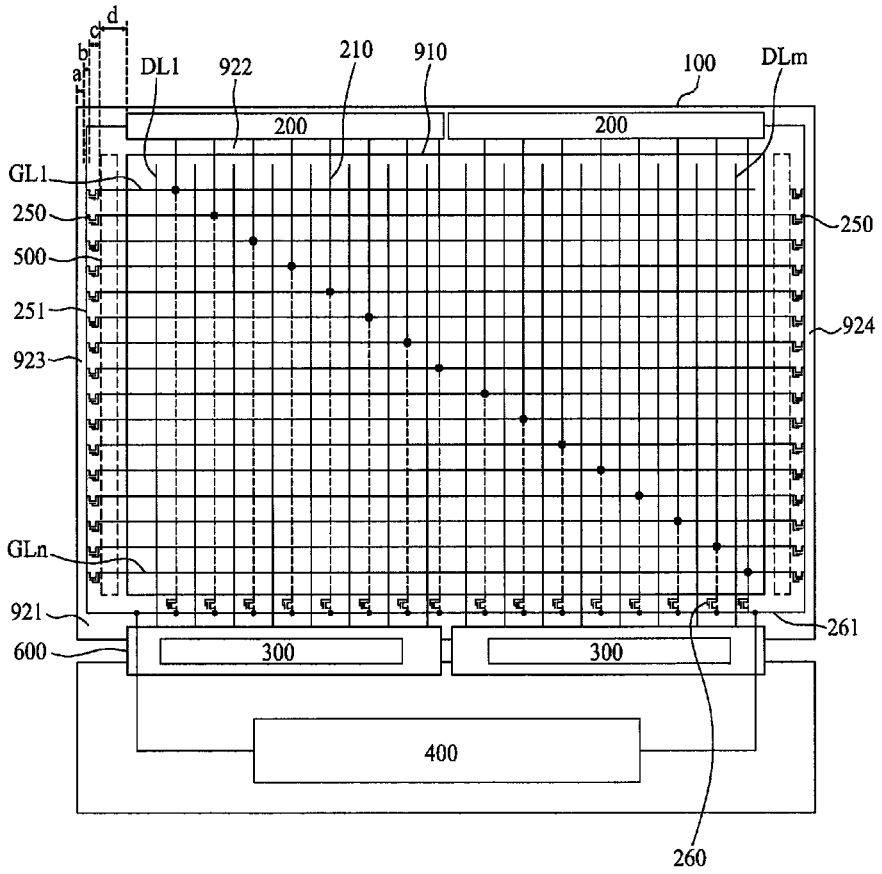
FIGS. 9-11 are various configuration diagrams respectively illustrating LCD devices according to other embodiments of the present invention.
Figure 10:
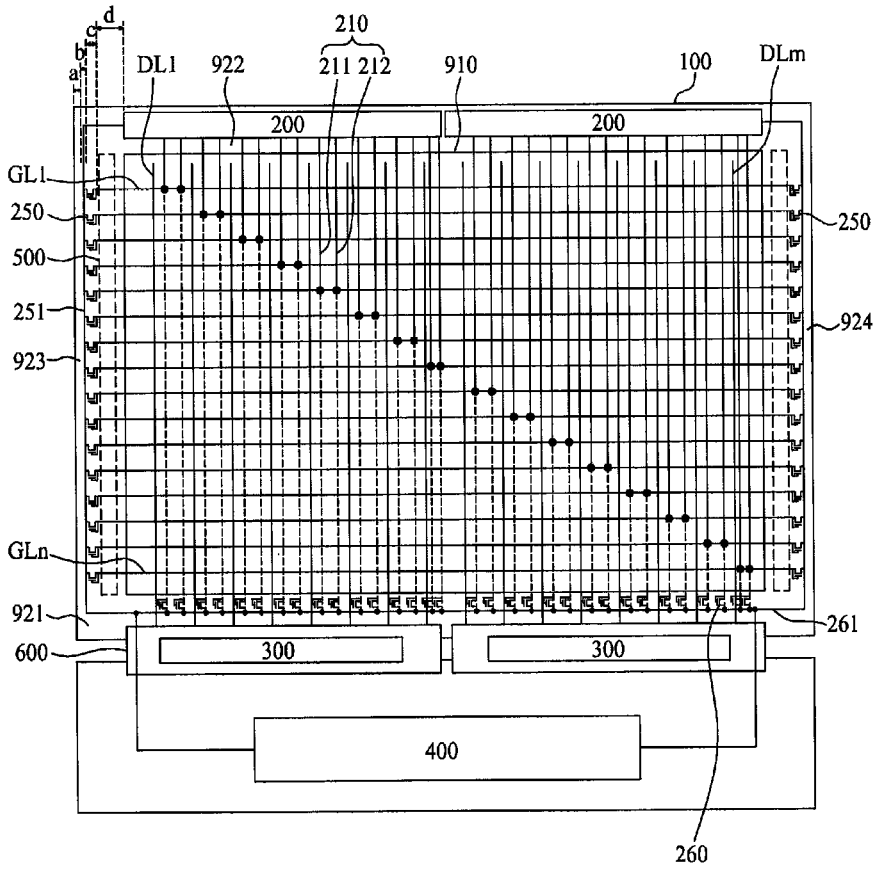
Figure 11:
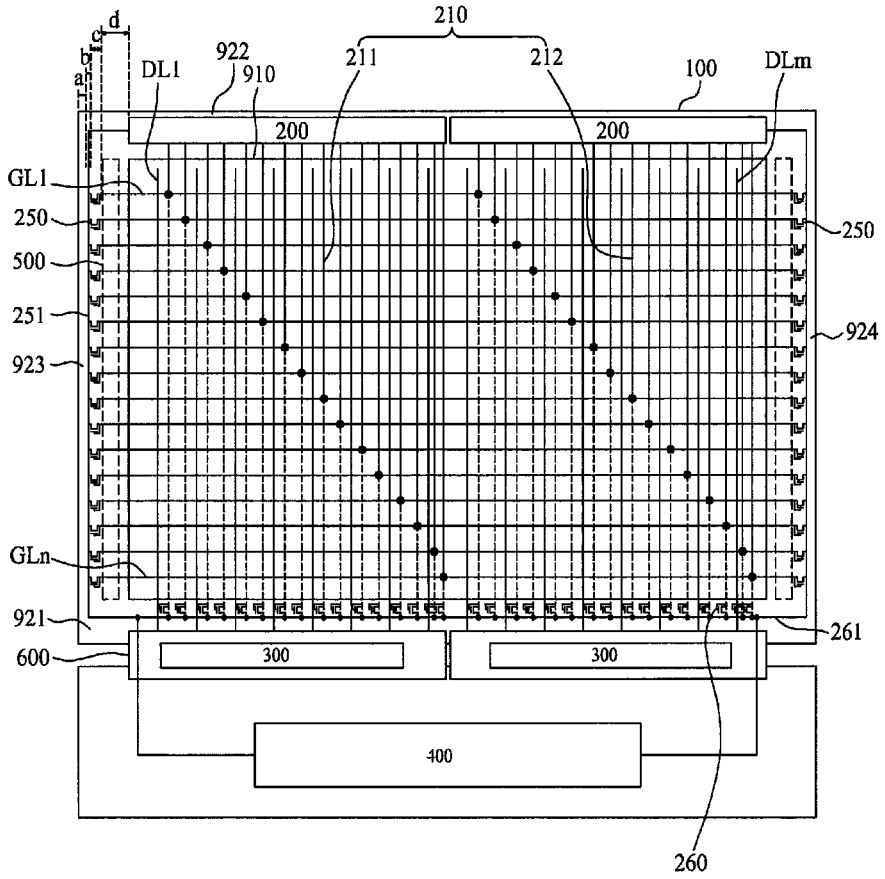

Turning now to FIGS. 9-11, which are similar to FIGS. 2, 4 and 5, but include a plurality of switching parts 250 and 260. The switching parts 250 and 260 include TFTs. Further, as shown, the switching parts 250 are formed in the non-display areas 923 and 924 and the switching parts 260 are formed in the non-display part 921.

In addition, each of the switching parts 250 is connected to a signal line 251 and each of the switching parts 260 is connected to a signal line 261. Thus, the switching parts 250 receive a gate high voltage VGH from the gate driver 200 via the signal lines 251 and a voltage clock signal from the timing controller 400. Further, the TFTs of the switching parts 250 are turned on when the gate high voltage VGH is applied to a corresponding gate line GL through the link line 210. Thus, an additional voltage is also applied to the gate line GL through the TFTs of the switching parts 250. A similar concept applies the switching parts 260 applying a voltage from the data driver 300 to turn on the TFTs of the switching parts 260. In addition, the embodiments shown in FIGS. 6-8 can also be modified to include the switching parts 250 and 260.

Thus, a faster and fuller charge can be applied and an amount of electrical charges charged into each pixel can be advantageously increased. Further, because the switching parts 250 are on both left and right sides of the display, the additional voltage is applied on both sides of the display. Thus, the scan signal is more uniformly distributed.

In the related art LCD device, the gate drivers 200 are respectively disposed in the left side (third non-display area 923) and right side (fourth non-display area 924) of the liquid crystal panel. However, embodiments of the present invention disposes the gate driver 200 in the second non-display area 922 facing the first non-display area 921 with the data driver 300 disposed therein, thus reducing widths of the left and right non-display areas of the LCD device. Accordingly, the present invention realizes a narrower bezel.

According to embodiments of the present invention, because the gate driver for applying the scan signal to the gate lines is disposed in the second non-display area facing the first non-display area with the data driver disposed therein in the non-display area, the left and right non-display areas of the LCD device can be minimized, thus realizing the narrower bezel.

Moreover, although the left and right non-display areas of the LCD device are minimized, the present invention does not reduce the size of the Vcom area, and thus prevents a quality degradation factor such as horizontal crosstalk.

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A display device, comprising:

a panel including a display area and first, second, third and fourth non-display areas formed at an outer portion of the display area, said first non-display area facing the second non-display area, and the third non-display area facing the fourth non-display area;

a data driver disposed in the first non-display area, and configured to drive a plurality of data lines provided in a first direction in the display area;

a gate driver disposed in the second non-display area facing the first non-display area with the data driver disposed therein and configured to drive a plurality of gate lines provided in a second direction vertical to the first direction in the display area;

a timing controller configured to drive the data driver and the gate driver; and a plurality of link lines in the display area and extending from the gate driver and provided in parallel to the data lines respectively connected to the gate lines, wherein at least two link lines are connected to one gate line and connect to the gate driver, wherein the at least two link lines connected to the one gate line are separated from each other by a distance interval greater than or equal to ⅓ of a length of the one gate line, and wherein the at least two link lines are perpendicular to the one gate line.

2. The display device of claim 1, wherein a P number of pixels arranged on one horizontal line in the display area are driven in a double rate driving (DRD) type by using two gate lines and P/2 number of data lines.

3. The display device of claim 1, wherein a common voltage area for applying a common voltage to the display area is formed in at least one of the third and fourth non-display areas.

4. The display device of claim 1, wherein the at least two link lines simultaneously apply a same scan signal at a same timing to the one gate line, and wherein at least two other link lines among the plurality of link lines are disposed between the at least two link lines connected to the one gate line.

5. The display device of claim 1, wherein the at least two link lines connected to the one gate line apply separate scan signals, output from the gate driver, to the one gate line.

6. The display device of claim 1, wherein the gate driver has "x" number of gate drivers, wherein a number of the link lines equals "x" times the number of gate lines, and wherein "x" is an integer.

7. The display device of claim 1, wherein the gate driver is disposed in a GIP type in the non-display area, or is connected to the non-display areas in a tape carrier package (TCP) type or a chip-on film (COF) type.

8. The display device of claim 1, wherein a plurality of scan signals are applied to the gate lines through the link lines in overlap with each other.

9. The display device of claim 8, wherein a rising edge of a second scan signal applied to a second gate line occurs before a falling edge of a first scan signal applied to a first gate line signal so the scan signals overlap with each other.

10. The display device of claim 8, further comprising:

a plurality of first switching parts in at least one of the third non-display area and the fourth non-display area, and respectively connected to corresponding gate lines; and a first signal line connected to each of the first switching parts, wherein a clock signal applied from the timing controller to the gate driver is also applied to the plurality of first switching parts via the first signal line to turn on respective switching parts and apply an additional voltage to the corresponding gate line.

11. The LCD device of claim 10, further comprising:

a plurality of second switching parts formed in the first non-display region, each second switching part being connected to a corresponding data line in a one-to-one manner; and a second signal line connected to each of the second switching parts and configured to receive a data voltage from the data driver so as to turn on a corresponding second switching part.

12. A method of driving a display device including a panel having a display area and first, second, third and fourth non-display areas formed at an outer portion of the display area, said first non-display area facing the second non-display area, and the third non-display area facing the fourth non-display area, and including a data driver disposed in the first non-display area, a plurality of data lines provided in a first direction in the display area, a gate driver disposed in the second non-display area facing the first non-display area with the data driver disposed therein, a plurality of gate lines provided in a second direction vertical to the first direction in the display area, a timing controller, and a plurality of link lines in the display area and extending from the gate driver and provided in parallel to the data lines respectively connected to the gate lines, the method comprising applying a plurality of scan signals, via the gate driver, to the gate lines through the link lines such that a rising edge of a second scan signal applied to a second gate line occurs before a falling edge of a first scan signal applied to a first gate line signal so the scan signals overlap with each other, wherein at least two link lines are connected to one gate line and connect to the gate driver, wherein the at least two link lines connected to the one gate line are separated from each other by a distance interval greater than or equal to ⅓ of a length of the one gate line, and wherein the at least two link lines are perpendicular to the one gate line.

13. The method of claim 12, wherein a P number of pixels arranged on one horizontal line in the display area are driven in a double rate driving (DRD) type by using two gate lines and P/2 number of data lines.

14. The method of claim 12, wherein a common voltage area for applying a common voltage to the display area is formed in at least one of the third and fourth non-display areas.

15. The method of claim 12, wherein the at least two link lines simultaneously apply a same scan signal at a same timing to the one gate line, and wherein at least two other link lines among the plurality of link lines are disposed between the at least two link lines connected to the one gate line.

16. The method of claim 12, wherein the at least two link lines connected to the one gate line apply separate scan signals, output from the gate driver, to the one gate line.

17. The method of claim 12, wherein the gate driver has "x" number of gate drivers, wherein a number of the link lines equals "x" times the number of gate lines, and wherein "x" is an integer.

18. The method of claim 12, wherein the gate driver is disposed in a GIP type in the non-display area, or is connected to the non-display areas in a tape carrier package (TCP) type or a chip-on film (COF) type.

* * * * *